US005971421A

United States Patent [19]

Hilgarth

[11] Patent Number: 5,971,421

[45] Date of Patent: Oct. 26, 1999

[54] SNOWBOARD SECURING DEVICE

[75] Inventor: Kurt Hilgarth, Graz-Seiersbach, Austria

[73] Assignee: Fancyform Design Engineering, Graz-Grambach, Austria

[21] Appl. No.: 09/068,525

[22] PCT Filed: Aug. 6, 1997

[86] PCT No.: PCT/AT97/00182

§ 371 Date: May 11, 1998

§ 102(e) Date: May 11, 1998

[87] PCT Pub. No.: WO98/06465

PCT Pub. Date: Feb. 19, 1998

[30] Foreign Application Priority Data

Aug. 9, 1996 [AT] Austria ..... 1441/96

[51] Int. Cl.[6] ..... A63C 9/00; A63C 5/00; A63C 9/10; B62B 9/04

[52] U.S. Cl. ..... 280/613; 280/607; 280/624; 280/625; 280/14.2

[58] Field of Search ..... 280/14.2, 613, 280/617, 623, 625, 631

[56] References Cited

U.S. PATENT DOCUMENTS

| | | | |
|---|---|---|---|
| 3,905,613 | 9/1975 | Romeo | 280/613 |
| 3,936,064 | 2/1976 | D'Alessio et al. | 280/613 |
| 4,060,256 | 11/1977 | Collombin et al. | 280/613 |
| 5,026,087 | 6/1991 | Wulf et al. | 280/613 |
| 5,299,823 | 4/1994 | Glaser | 280/617 |
| 5,474,322 | 12/1995 | Perkins et al. | 280/613 |

FOREIGN PATENT DOCUMENTS

| | | |
|---|---|---|
| 2673546 | 9/1992 | France . |
| 29608353 | 7/1996 | Germany . |
| 296 08 353 U1 | 8/1996 | Germany . |
| WO95/20423 | 8/1995 | WIPO . |

*Primary Examiner*—Lanna Mai
*Assistant Examiner*—Jeff Restifo
*Attorney, Agent, or Firm*—Jacobson, Price, Holman & Stern, PLLC

[57] ABSTRACT

A binding for snowboards and also to a boot with such a binding. To facilitates stepping in and out, the binding has a binding plate (5) which is provided with lateral holding (retaining) members on both sides of the boot sole in its central longitudinal zone and which is connected to a base plate (6) or the surface of the snowboard, characterised in that the retaining members are formed by side walls (3) diverging from one another conically upwards preferably in the upper portion, and disposed on the binding is a pivotable sprung clamp (1), whose ends or elements connected to the ends extend inwards through substantially horizontal holes (4) in the side walls (3), while a boot can be locked to the binding via the ends (2) of the sprung clamp (1) or elements connected thereto and can be again unlocked by the pivoting of the sprung clamp (1). The interface (12) which extends laterally upwards from the central zone of the boot sole (14) is preferably made of a harder material than the boot body (11).

16 Claims, 5 Drawing Sheets

SNOWBOARD SECURING DEVICE

Figure 1:
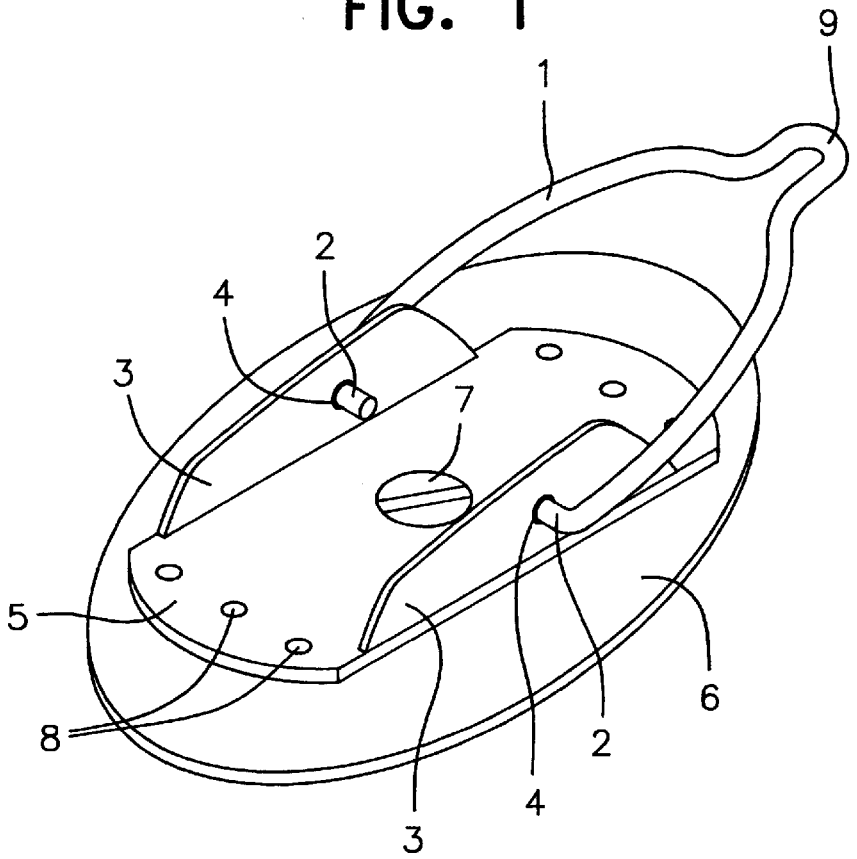

The invention relates to a binding for snowboards with a binding plate provided with lateral retaining members on both sides of the boot sole in its central longitudinal zone, the binding plate being connected to a base plate or the surface of the snowboard and also to a boot and such a binding for snowboards wherein the boot has an interface made from a preferably harder material than the boot body.

The riding of snowboards is connected with frequent stepping into and out of the binding. When queuing at a T-bar lift, a boot must be lifted out of the binding to make forward movement possible. In the case of other transportation means such as, for example, chair lifts or cable ways the snowboard is carried in the hand or mounted on the cabin, for which purpose the snowboarder must step with both boots out of the binding.

In known binding systems the mechanisms by which stepping out of the binding is made possible are situated directly on the surface of the snowboard, so that when stepping out of the binding the snowboarder must bend down low to be able to actuate the release mechanism by hand. A facilitation, which is achieved with traditional skis by actuating the release mechanism using the ski pole is not possible with snowboards, with which no poles are used. Stepping into the binding is also made difficult, since the snowboarder must step into the binding with the boot without being supported on ski poles. This may represent a difficult manoeuvre, more particularly on a steep piste. In prior art binding systems no means are present for the exact positioning of the boot in the binding.

For example, WO 96/05894 discloses a snowboard binding in which retaining parts of the binding engage on both sides of the boot sole in its central longitudinal zone. Locking is performed by a locking mechanism disposed at the side. By lifting the bolt, stepping out of the binding is made possible. However, this binding provides no adequate guiding function, so that an exact positioning of the boot in the binding is not easily possible.

It is an object of the invention to create measures which facilitate stepping in and out of the snowboard binding while avoiding the aforementioned disadvantages.

This problem is solved according to the invention by the features that the retaining members are formed by side walls, and disposed on the binding is a pivotable sprung clamp whose ends or elements such as, for example, bolts or the like connected to the ends extend inwardly through substantially horizontal holes in the side walls, while a boot can be locked to the binding via the ends of the sprung clamp or elements such as, for example, bolts or the like connected thereto, and again unlocked by the pivoting of the sprung clamp.

By the side walls the binding zone is fixed in position, whereby the exact placing of the boot in the binding is facilitated. During stepping into the binding the sprung clamp is pressed apart and finally the ends of the sprung clamp or elements such as, for example, bolts or the like connected thereto latch into devices provided for the purpose in the boot and therefore lock the boot to the binding. For stepping out the sprung clamp is pivoted, preferably pressed downwards and then by, for example, corresponding shaping of the side walls the sprung clamp is forced apart and therefore the ends of the sprung clamp or the elements such as, for example, bolts or the like connected thereto are drawn out of the locking devices of the boot, whereafter the boot is unlocked and the snowboarder can step out of the binding.

If the side walls diverge from one another conically upwards at least in the upper portion, stepping in is even further facilitated, since the snowboarder need not position his boot exactly on the binding. The boot is guided into the binding by the conical side walls.

Further advantages are achieved if at least one of the two side walls is adjustable in the transverse direction and is preferably fixable in the adjusted position or the two side walls are connected via a spring or the like.

According to a further feature of the invention, preferably at the place extending furthest away from the binding the sprung clamp is connected to a preferably upwardly pointing bowed portion or is constructed as such. By the bowed portion or the like the actuation of the sprung clamp for the unlocking of the boot in the binding is facilitated. As far as possible the bowed portion or the like will extend upwards as far as possible, so that the snowboarder must bend as little as possible when stepping out of the binding.

If the sprung clamp is displaceable in the longitudinal direction for adaptation to the boot size, the sprung clamp can serve as a further positioning aid when stepping into the binding. Furthermore the sprung clamp exactly adapted to the boot size can engage in a notch or the like correspondingly provided, for example, in the boot.

To guarantee a movement of the binding in relation to the snowboard, an elastic material, for example, in the form of a O-ring can be disposed between the binding plate and the base plate or the surface of the snowboard. As a result a three-dimensional mobility of the binding in relation to the base plate and the snowboard is attained, something which has a positive effect on the travelling properties.

Additionally, the elasticity of the interposed material can be adjusted by a number of set screws disposed between the binding plate and the base plate or the surface of the snowboard for the adjustable connection of the distance between the binding plate and the base plate or the surface of the snowboard. By this measure the mobility can be influenced in different spatial directions for the optimisation of the travelling properties.

The problem according to the invention is also solved by a boot and a binding having the aforementioned features, wherein the interface extends upwards and at least partially conically outwards from the central zone of the boot sole, and the interface has laterally substantially horizontal holes or the like for the locking of the boot to a binding. The zone formed by the interface of harder material facilitates stepping into a binding which is constructed with corresponding means for latching into the devices provided for this purpose on the boot. Due to the fact that the interface according to the invention extends only in the central zone of the sole, the sole can be constructed soft in the front and rear zone, thus enhancing walking comfort. Due to the hard zone on the boot a rigid connection to the binding is possible. The material of the interface can also be identical with that of the boot body and therefore also have the same hardness.

According to a preferred embodiment the interface is connected to one or more buckles of the boot.

Additional advantages as regards the stability of the boot can be achieved if the interface is preferably pivotably connected to a collar or the like of a preferably harder material than the boot body.

Lastly, the best and simplest solution of the problem according to the invention consists in a combination of the binding and the boot for snowboards with at least one of the preceding features in each case, wherein the ends of the sprung clamp or elements such as, for example, bolts or the like connected thereto extend in one position of the sprung clamp into the holes in the interface of the boot for the locking of the boot to the binding, and the ends of the sprung clamp or elements such as, for example, bolts or the like connected thereto can be deflected from the binding by the pivoting of the sprung clamp out of said position out of the holes in the interface of the boot for the unlocking of the boot from the binding. The advantages already mentioned above are obtained.

An additional security of the locking is created if in the locked position a portion of the sprung clamp engages in a notch or the like provided for this purpose in the boot.

Figure 2:
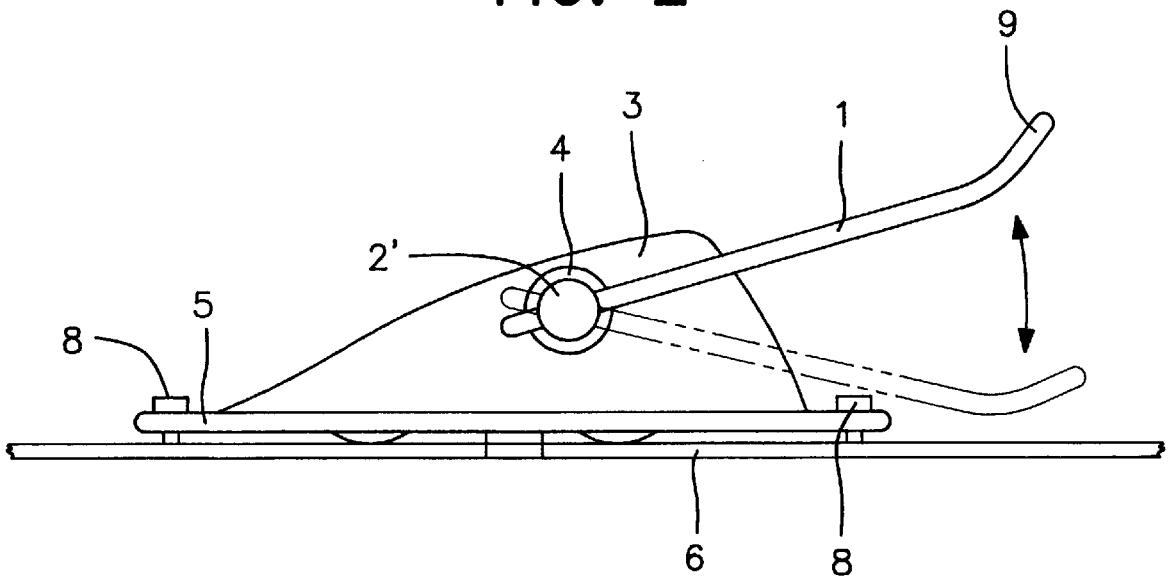
Figure 1A:
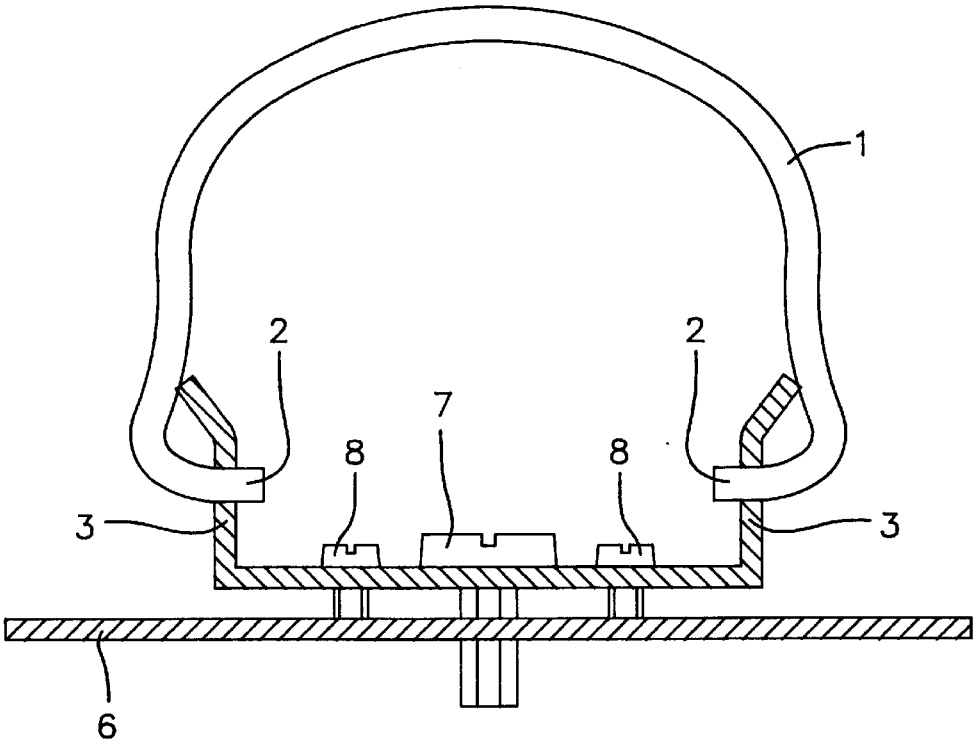
Figure 1B:
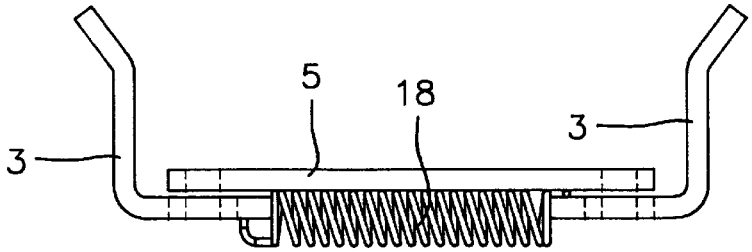
Figure 1C:
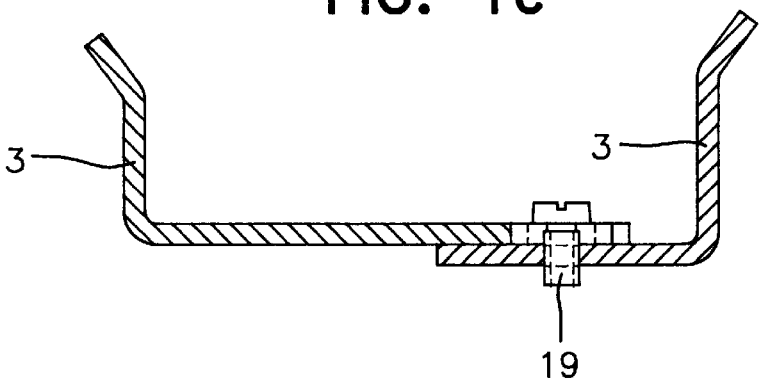
Figure 3A:
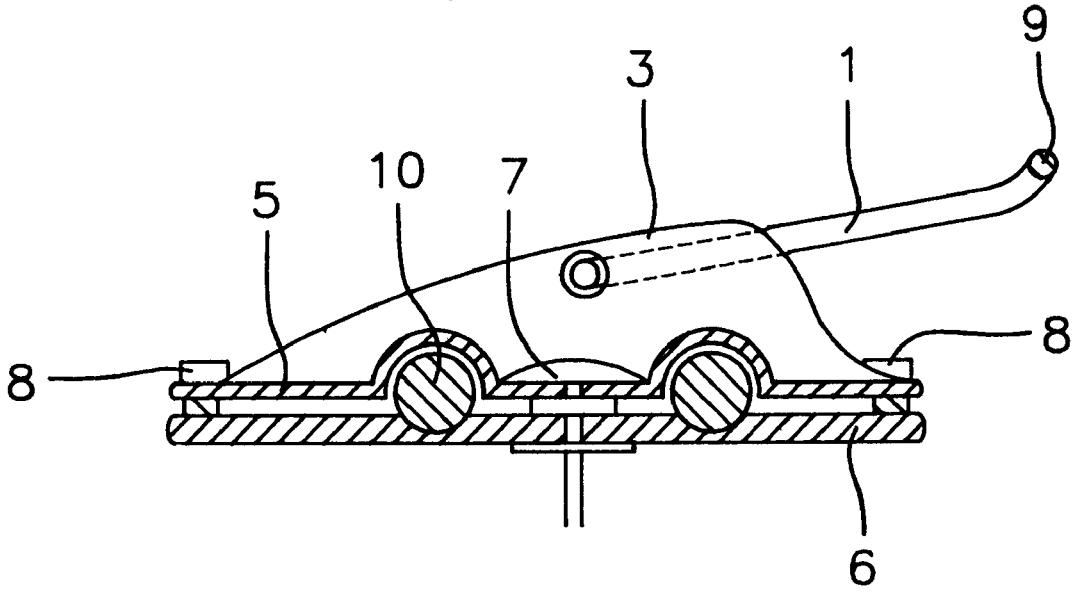
Figure 3B:
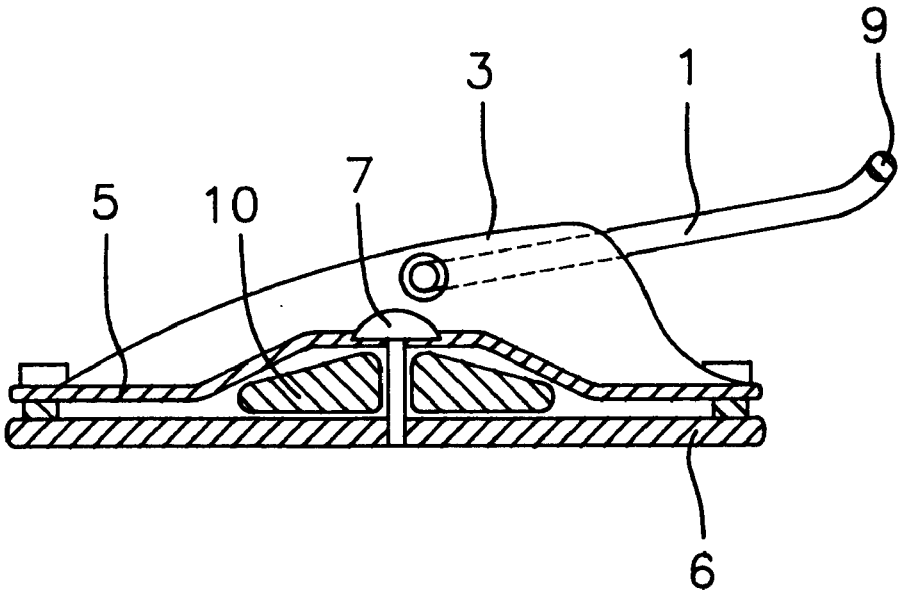
Figure 4:
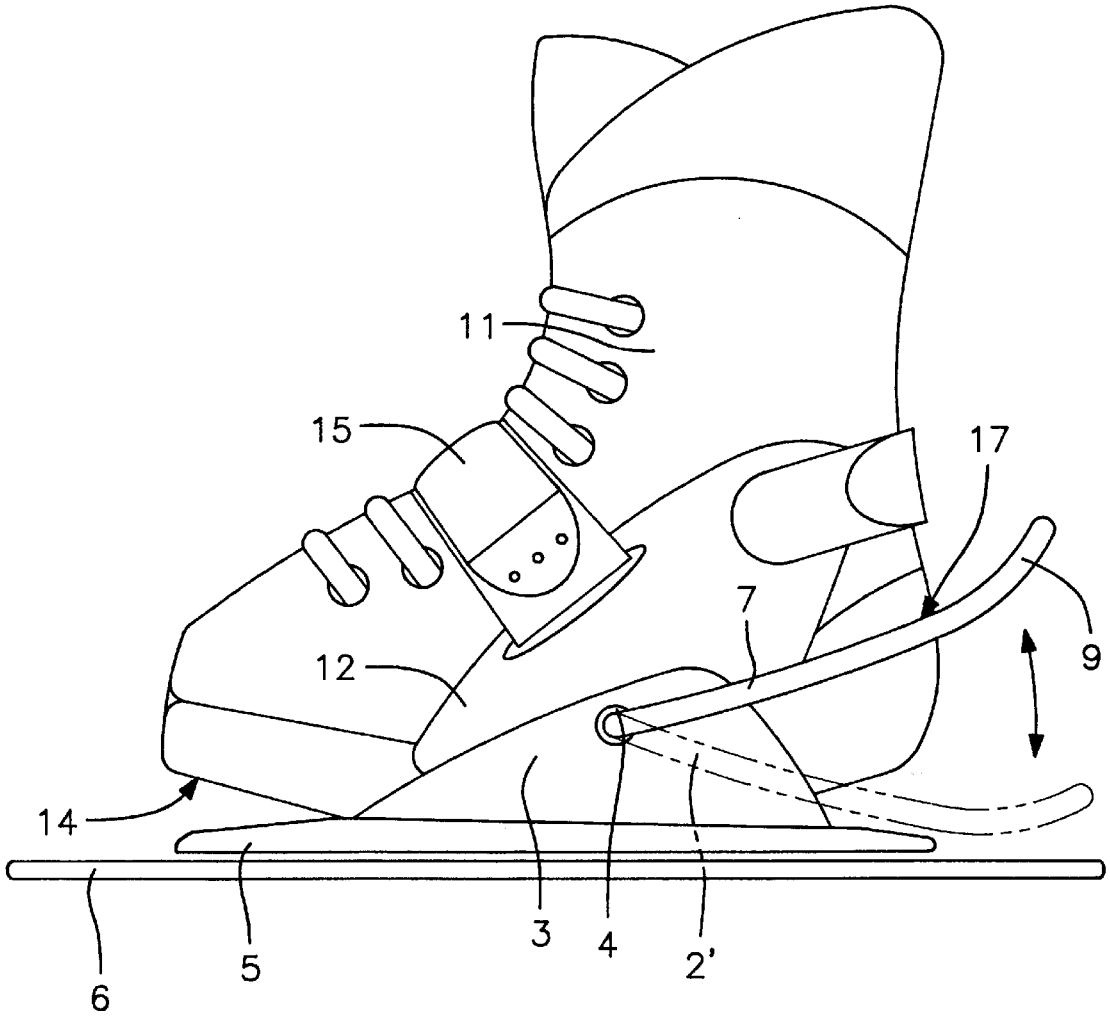

The features of the invention will be explained in greater detail with reference to the accompanying drawings, which show:

FIG. 1—the binding according to the invention in a perspective view,

FIG. 1*a*—a front sectional view of a binding showing the side walls diverging from one another conically upward, FIG. 1*b*—a front elevation of a portion of a binding wherein the side walls are connected via a spring, FIG. 1*c*—a front sectional view of a portion of a binding wherein the side walls are fixable in the adjusted position, and FIG. 2—a slightly modified embodiment of the binding in side elevation, FIGS. 3*a* and 3*b*—a snowboard binding shown laterally in section, FIG. 4—the binding with the boot in side elevation, and FIGS. 5*a* to 5*d*—different embodiments of a snowboard boot according to the invention.

The snowboard binding shown in FIG. 1 and FIG. 1*a* has a sprung clamp 1 which is closed around the heel area. Theoretically, the sprung clamp 1 might also be closed around the toe area. Ends 2 of the sprung clamp 1, which are pre-stressed towards one another, extend through substantially horizontal holes 4 in side walls 3. The side walls 3 are attached or welded or the like to a binding plate 5. Advantageously the binding plate 5 and the side walls 3 are produced in one piece. The side walls 3 form a guide for the boot and facilitate the stepping-in and correct positioning of the boot in the binding. Stepping-in is even further facilitated if the side walls 3 diverge from one another conically upwards at least in the upper portion. The portion of the sprung clamp 1 extending furthest away from the binding is constructed in the form of a bowed portion 9. Naturally this bowed portion, used for actuating the sprung clamp 1, can also be disposed laterally, but advantageously it is situated at the highest place of the sprung clamp 1, to design the actuation thereof as comfortably as possible. Instead of the construction of the sprung clamp 1 in the form of a bowed portion 9 or the like, a corresponding element can also be connected to the sprung clamp 1. The binding plate is connected to a base plate 6 via a central attaching screw 7. The binding plate 5 might also be screwed directly to the surface of the snowboard. Naturally, instead of the screw 7 other attaching means are also possible. So-called set screws 8 are used for the adjustable connection of the distance between the binding plate 5 and the base plate 6 or the surface of the snowboard. The purpose of the set screws 8 will be further explained below with reference to FIGS. 3*a* and 3*b*. By the actuation of the sprung clamp 1, preferably by pressing it downwards, by, for example, a corresponding shaping of the outer surfaces of the side walls 3 the sprung clamp 1 is forced apart and thereby the ends 2 of the sprung clamp 1, which serve for the locking of the boot to the binding, are forced apart.

In FIGS. 1*b* and 1*c* the side walls are adjustable in the transverse direction and are fixable in the adjusted position via a screw 19 (FIG. 1*c*) or the side walls are connected via a spring 18 (FIG. 1*b*).

In FIG. 2, in comparison with FIG. 1, it is not the ends 2 of the sprung clamp 1 extending through the holes 4 in the side walls 3, but bolts 2' which are connected to the ends of the sprung clamp 1. Instead of the bolts 2', other elements which are suitable for locking the boot to the binding are also possible. In the example illustrated the sprung clamp 1 can be displaced in relation to the bolts 2'. As a result an easy adaptation of the binding to different boot sizes is possible. In the example illustrated the sprung clamp 1 is inclined downwards in the opened state. In the closed state, in which the boot is fixed on the binding, the sprung clamp 1 is directed upwards. Stepping out is made possible by pressure on the bowed portion 9 of the sprung clamp 1. If the sprung clamp 1 is adapted to the boot size, the portion of the sprung clamp 1 constructed as a bowed portion 9 can act as a further positioning aid during stepping-in. The boot is positioned with the heel in the guide formed thereby, and thereafter the boot is fixed to the binding by inclining the boot forwards.

FIGS. 3*a* and 3*b* show two embodiments of the snowboard binding according to the invention in section from the side. An elastic material in the form of a O-ring 10 is disposed between the binding plate 5 and the base plate 6. If the binding plate 5 is mounted directly on the surface of the snowboard, the elastic material can also be disposed between the binding plate 5 and the snowboard surface. By this measure a slight three dimensional mobility is allowed between the binding and the base plate 6 and the surface of the snowboard respectively. The central attaching screw 7 for the attachment of the binding plate 5 to the base plate 6 is situated in the centre of the O-ring 10. By adjustment of the screw 7 or similar attaching means the elasticity of the material of the O-ring 10 can be changed. By the set screws 8 between the binding plate 5 and the base plate 6 or surface of the snowboard, which are disposed outside the O-ring 10, the mobility of the binding plate 5 can be adjusted in relation to the base plate 6 or the surface of the snowboard in dependence on the direction, something which may be advantageous for the travelling properties. In FIG. 3*b* the O-ring 10 has a different cross-section in conical shape in comparison with the O-ring 10 in FIG. 3*a*.

FIG. 4 shows the binding to a boot in side elevation. The boot body 11 is provided with an interface 12 which is made from a preferably harder material than the boot body 11 and which extends in the central zone of the sole 14 and extends upwards on both sides of the boot. Laterally the interface 12 has substantially horizontal holes 13 through which the ends 2 of the sprung clamp 1 or elements such as, for example, bolts 2 or the like connected thereto engage and lock the boot in the binding. Stepping into the binding is further facilitated by the interface 12 which extends laterally and conically upwards. On stepping into the binding, the bolts 2' on the sprung clamp 1 are forced apart and the sprung clamp 1 jumps upwards by the tensioning, while at the same time the bolts 2' latch into the holes 13 in the interface 12. The sprung clamp 1 can latch into a notch 17 in the boot, on condition that the sprung clamp is adapted to the boot size.

Figure 5A:
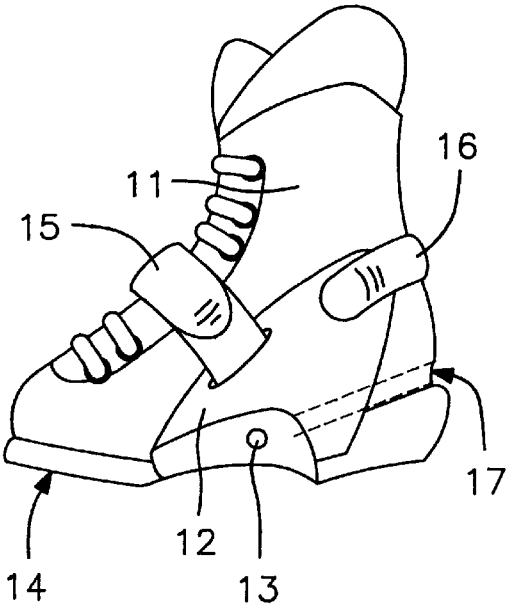
Figure 5C:
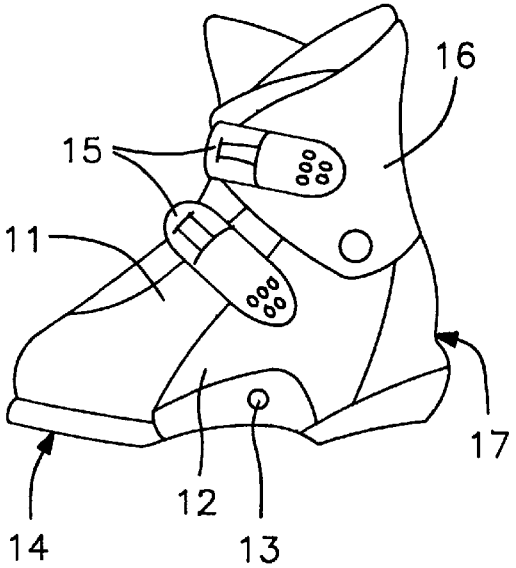
Figure 5B:
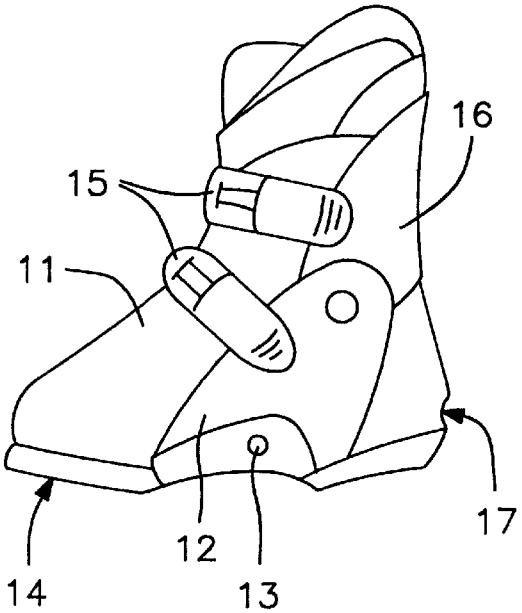
Figure 5D:
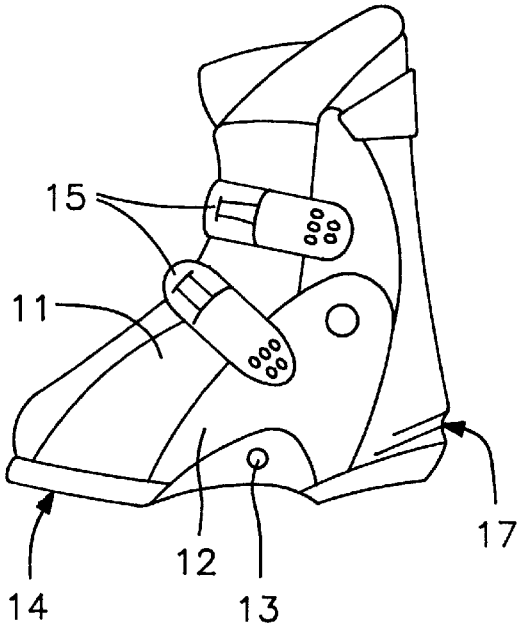

FIGS. 5*a* to 5*d* show different embodiments of the snowboard boot according to the invention. FIG. 5*a* shows a snowboard boot consisting of a boot body 11 and the interface 12, which is connected to a buckle 15 of the boot and is pivotally connected to a collar 16. In FIG. 5*b* the collar 16 is extended upwards and provides additional steadiness (hold). In FIG. 5*c* the collar 16 pivotally connected to the interface 12 is disposed around the upper portion of the boot and connected to a buckle. In the embodiment shown in FIG. 5*d* the interface 12 is pulled up laterally as far as the edge of the boot body 11 and the interface 12 is connected to two buckles 15 of the boot. A larger interface 12 or a connection to any collars 16 or the like provides greater stability in the binding but on the other hand less comfort in walking with the boot, whereas a small interface 12 provides less stability in the binding but on the other hand greater comfort during walking. A compromise must be found between the steadiness in the binding and comfort in walking, in accordance with the application and the snowboarder's wish.

The drawings show merely exemplary embodiments which can be modified in the most various manner within the scope of the invention.

I claim:

1. A binding for snowboards with a binding plate (5) provided with lateral retaining members on both sides of the boot sole in its central longitudinal zone, the binding plate (5) being connected to a base plate (6) or the surface of the snowboard, wherein the retaining members are formed by side walls (3), which side walls (3) diverge from one another conically upwards at least in the upper portion and disposed on the binding is a pivotable sprung clamp (1) whose ends (2) or elements connected to the ends extend inwardly through substantially horizontal holes (4) in the side walls (3), while a boot can be locked to the binding via the ends (2) of the sprung clamp (1) or elements connected thereto, and again unlocked by the pivoting of the sprung clamp (1).

2. A binding according to claim 1, wherein the side walls (3) are adjustable in the transverse direction and are fixable in the adjusted position or the side walls (3) are connected via a spring (18).

3. A binding according to claim 1, wherein the sprung clamp (1) is connected to a bowed portion (9) or the sprung clamp (1) is constructed in a form of a bowed portion (9).

4. A binding according to claim 1, wherein the spring clamp (1) is displaceable in the longitudinal direction for adaptation to the boot size.

5. A binding according to claim 1, wherein an elastic material, is disposed between the binding plate (5) and the base plate (6) or the surface of the snowboard.

6. A binding according to claim 5, wherein a number of set screws (9) for the adjustable connection of the distance between the binding plate (5) and the base plate (6) or the surface of the snowboard are disposed between the binding plate (5) and the base plate (6) or the surface of the snowboard.

7. A binding for snowboards, wherein the boot has an interface (12) optionally made from a harder material than the boot body, characterised in that the interface (12) extends upwards and at least partially conically outwards from the central zone of the boot sole (14), and the interface (12) as laterally substantially horizontal holes (13) for the locking of the boot to a binding.

8. A binding according to claim 7, wherein the interface is connected to one or more buckles (15) of the boot.

9. A binding according to claim 7, wherein the interface (12) is connected to a collar (16) of a harder material than the boot body (11).

10. A binding according to claim 7, wherein the ends (2) of the sprung clamp (1) or elements connected thereto extend in one position of the sprung clamp (1) into the holes (13) in the interface (12) of the boot for the locking of the boot to the binding, and the ends (2) of the sprung clamp (1) or elements such as, for example, bolts (2') or the like connected thereto can be deflected from the binding by the pivoting of the sprung clamp (1) out of said position out of the holes (13) in the interface (12) of the boot for the unlocking of the boot from the binding.

11. A binding according to claim 10, wherein in the locked position a portion of the sprung clamp (1) engages in a notch (17) or the like provided for this purpose in the boot.

12. A binding according to claim 1, wherein the elements connected to the ends of the pivotable sprung clamp are bolts.

13. A binding according to claim 1, wherein at the place extending furthest away from the binding the sprung clamp (1) is connected to a bowed portion (9) or the sprung clamp (1) is constructed in the form of a bowed portion (9).

14. A binding according to claim 1, wherein the sprung clamp (1) is connected to an upwardly pointing bowed portion (9) or the sprung clamp (1) is constructed in the form of an upwardly pointing bowed portion (9).

15. A binding according to claim 1, wherein an elastic material in the form of an O-ring (10) is disposed between the binding plate (5) and the base plate (6) or the surface of the snowboard.

16. A binding according to claim 7, wherein the interface (12) is pivotably connected to a collar (16) of a harder material than the boot body (11).

* * * * *